US005691697A

United States Patent [19]

Carvalho et al.

[11] Patent Number: 5,691,697

[45] Date of Patent: Nov. 25, 1997

[54] SECURITY SYSTEM

[75] Inventors: Carlos E. Carvalho, Tyngsboro; John P. Osborne, Holland; Donald O. Hallee, N. Easton, all of Mass.

[73] Assignee: Kidde Technologies, Inc., Marlborough, Mass.

[21] Appl. No.: 532,351

[22] Filed: Sep. 22, 1995

[51] Int. Cl.[6] ..... G08B 13/20

[52] U.S. Cl. ..... 340/544; 340/426; 340/945

[58] Field of Search ..... 340/544, 426, 340/945

[56] References Cited

U.S. PATENT DOCUMENTS

| | | | |
|---|---|---|---|
| 4,538,140 | 8/1985 | Prestel | 340/556 |
| 4,647,913 | 3/1987 | Pantus | 340/506 |
| 4,797,657 | 1/1989 | Vorzimmer et al. | 340/945 |
| 4,920,332 | 4/1990 | Philippe | 340/544 |
| 4,933,668 | 6/1990 | Oyer et al. | 340/541 |
| 5,021,766 | 6/1991 | Genähr et al. | 340/544 |
| 5,063,371 | 11/1991 | Oyer et al. | 340/541 |
| 5,185,593 | 2/1993 | DuRand, III et al. | 340/544 |
| 5,376,919 | 12/1994 | Rickman | 340/544 |

OTHER PUBLICATIONS

Fenwal Safety Systems Proposal SS-694, dated Jun. 27, 1994.

March Industries Brochure.

Quorum International, Ltd. Security Monitor.

Quorum Product Line Literature 1994.

*Primary Examiner*—Glen Swann

*Attorney, Agent, or Firm*—Fish & Richardson P.C.

[57] ABSTRACT

A security system includes a pressure sensing circuit for generating an electrical signal in response to changes in pressure and a signal processing circuit, connected to receive the electrical signal, for determining whether the electrical signal represents an intrusion pattern. A pressure sensing circuit generates an electrical signal in response to changes in pressure and a trigger circuit for determining whether an intrusion has occurred by determining whether a peak of the electrical signal has an amplitude that exceeds a floating amplitude threshold, wherein the floating amplitude threshold compensates for ambient noise in the enclosed area. A monitor mode measures intrusion data in a specific enclosed area and determines security system thresholds in accordance with the measured intrusion data.

46 Claims, 12 Drawing Sheets

SECURITY SYSTEM

BACKGROUND

This invention relates to security systems.

Currently many new planes or homes are manufactured to include built-in security systems for detecting intrusions using a variety of types of sensors. A portable security system may be easily placed in an already built plane or a home when intrusion detection is required. One security system generates one or more infrared beams. If any infrared beam is broken, the system sets off an alarm indicating a possible intrusion.

Another security system includes an air pressure sensor which generates an electrical signal in response to changes in the air pressure within an enclosed area. If, for example, a door is opened, then the electrical signal generated by the air pressure sensor increases and decreases in amplitude (positive and negative peaks) in accordance with the detected changes in air pressure. The negative peaks are inverted into positive peaks, and the increase in amplitude associated with the positive peaks is used to charge a capacitor. If the capacitor is fully charged and at least one peak exceeds a threshold, then the security system determines that an intrusion has occurred and generates an alarm.

SUMMARY

In one general aspect, the invention features a security system including a pressure sensing circuit for generating an electrical signal in response to changes in pressure and a signal processing circuit, connected to receive the electrical signal, for determining whether the electrical signal represents an intrusion pattern.

Implementations of the invention may include one or more of the following. The electrical signal may be an analog signal, and the signal processing circuit may sample the analog signal and determine whether the samples represent the intrusion pattern. The security system may further include a notification circuit for providing an external alarm notification and an event logging circuit for writing event data to an event log. The signal processing circuitry may include a digital signal processing circuit or condition detection circuitry for determining whether the electrical signal meets at least one predetermined condition.

The security system may further include a trigger circuit for determining whether the electrical signal represents a possible intrusion and for waking up the signal processing circuit when the electrical signal represents a possible intrusion. The trigger circuit may determine whether a peak of the electrical signal has an amplitude that exceeds an amplitude threshold, and the amplitude threshold may be a floating amplitude threshold that compensates for ambient noise. The trigger circuit may also determine whether a peak of the electrical signal has a pulse width that exceeds a pulse width threshold.

The pressure sensing circuit may include a temperature compensation circuit, a frequency compensation circuit, an adjustable gain calibration circuit, and/or an adjustable μbar range select circuit.

The signal processing circuit may further determine whether the electrical signal represents another intrusion pattern, and the signal processing circuit may determine whether the electrical signal represents the intrusion pattern by comparing the electrical signal to a set of predetermined thresholds. The set of predetermined thresholds may be specific to an enclosed area within which the security system is to be used, and a user may establish the threshold values. The enclosed area may be an aircraft, and the set of thresholds may in accordance with a user selected aircraft type.

The security device may further include a display device and a entry/exit button for displaying, on the display device, available preset system thresholds. The security device may also include a select button for selecting particular preset available thresholds. The entry/exit button may further cause display of a menu for modification of system thresholds and the select button may select modified system thresholds. The menu may include an event menu for displaying, erasing, or dumping an event log or a monitor menu for measuring intrusion data.

The security system may be portable.

In another general aspect, the invention features a method of detecting intrusions including sensing changes in pressure, generating an electrical signal in response to the sensed changes in pressure, and determining whether the electrical signal represents an intrusion pattern.

In another general aspect, the invention features a security system including a pressure sensing circuit for generating an electrical signal in response to changes in pressure and a trigger circuit for determining whether an intrusion has occurred by determining whether a peak of the electrical signal has an amplitude that exceeds a floating amplitude threshold, where the floating amplitude threshold compensates for ambient noise in the enclosed area.

In another general aspect, the invention features a method of determining security system thresholds by providing a security system with a monitor mode for measuring intrusion data in a specific enclosed area and for determining security system thresholds in accordance with the measured intrusion data.

Implementations of the invention may include one or more of the following. The method may include placing the security system in an enclosed area and selecting the monitor mode of the security system. The method may also include intruding into the enclosed area, detecting the intrusion, and measuring intrusion data associated with the intrusion. Furthermore, the method may include determining the security system thresholds from the measured intrusion data.

The advantages of the invention may include one or more of the following. Sampling an output signal from an air pressure sensor and performing pattern recognition on the sampled data with a digital signal processor may reduce the number of false alarms and allow the signal processing to be customized to the environment in which the security system is used. Using a trigger circuit to initiate sampling and processing by the digital signal processor reduces power consumption allowing the security system to use smaller batteries which reduces the size, weight, and cost of the security system. Improving the frequency response characteristic of the trigger circuit enables the detection of extreme (i.e., very slow or very fast) air pressure changes. Comparing the electrical signal generated by the air pressure sensor to a threshold which is automatically and continuously adjusted to compensate for slow changes in ambient air pressure prevents a slow increase or decrease in air pressure caused by, for example, the wind, an incoming storm system, or a hovering helicopter, from setting an alarm or triggering digital signal processing. Determining whether the pulse width of a single pulse exceeds a predetermined threshold for a predetermined period of time prevents ambient noise with a very small or very large pulse width from setting an alarm or triggering digital signal processing.

A portable security system is generally less expensive than a built-in system. Moreover, the portable security system may be easily used in an already built plane or home.

Other advantages and features will become apparent from the following description and from the claims.

DESCRIPTION OF THE PREFERRED EMBODIMENTS

Figure 1:
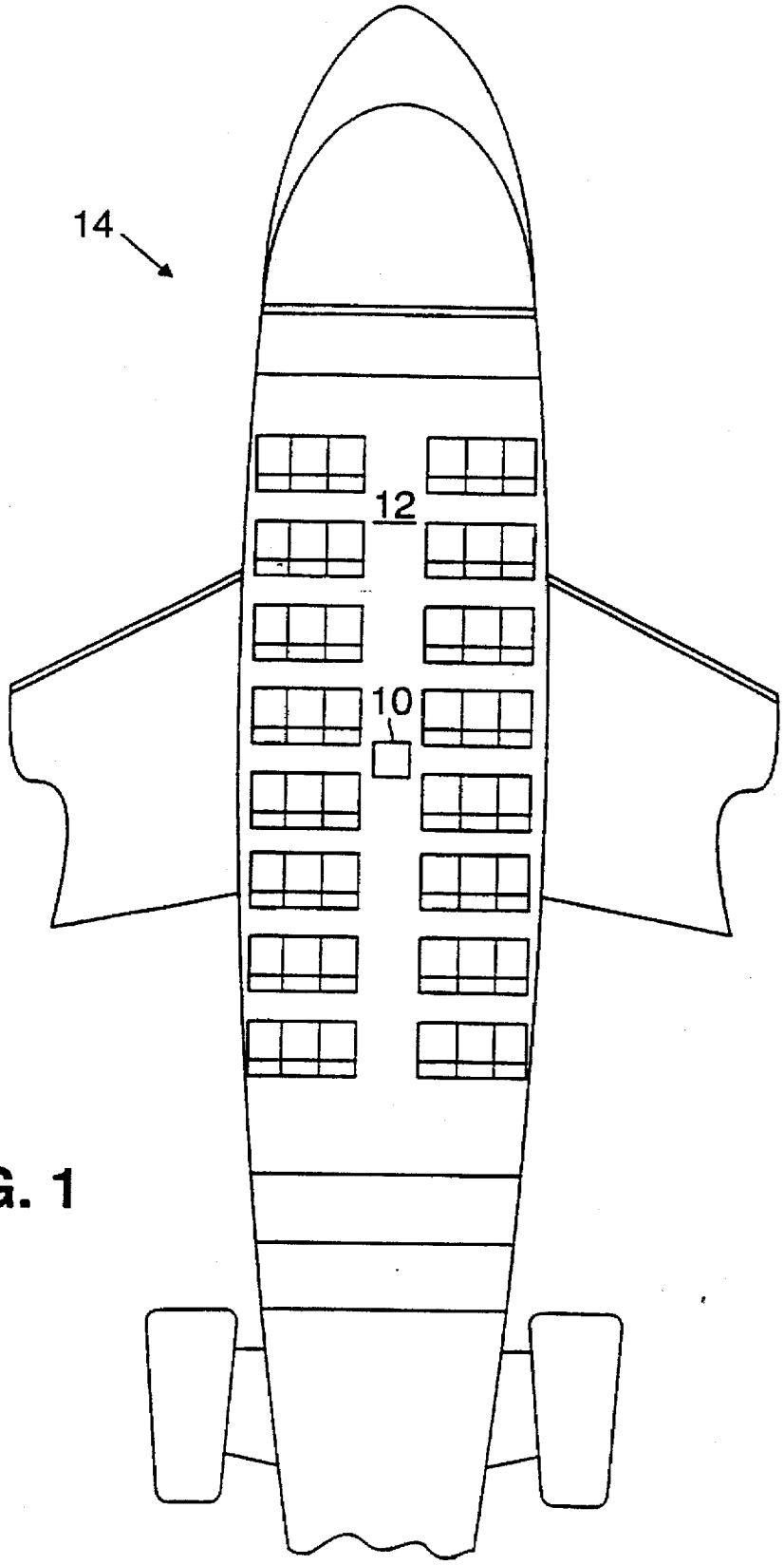
FIG. 1 is a top cross-sectional view of a airplane.

A portable security system (PSS) for detecting changes in air pressure may be used in a variety of locations, for instance, in a plane, house, business, nuclear facility, bank, or yacht, to detect and log intrusions. Referring to FIG. 1, a PSS 10 for detecting changes in air pressure is located in a main aisle 12 of an unoccupied plane 14. If an intrusion occurs, for example, a cabin or cargo door (or a portion, for example, 8" by 11", of a cargo door) is opened or an intruder walks within the plane, the air pressure around PSS 10 changes and the PSS detects the change, sets an alarm, and logs the event.

Figure 2:
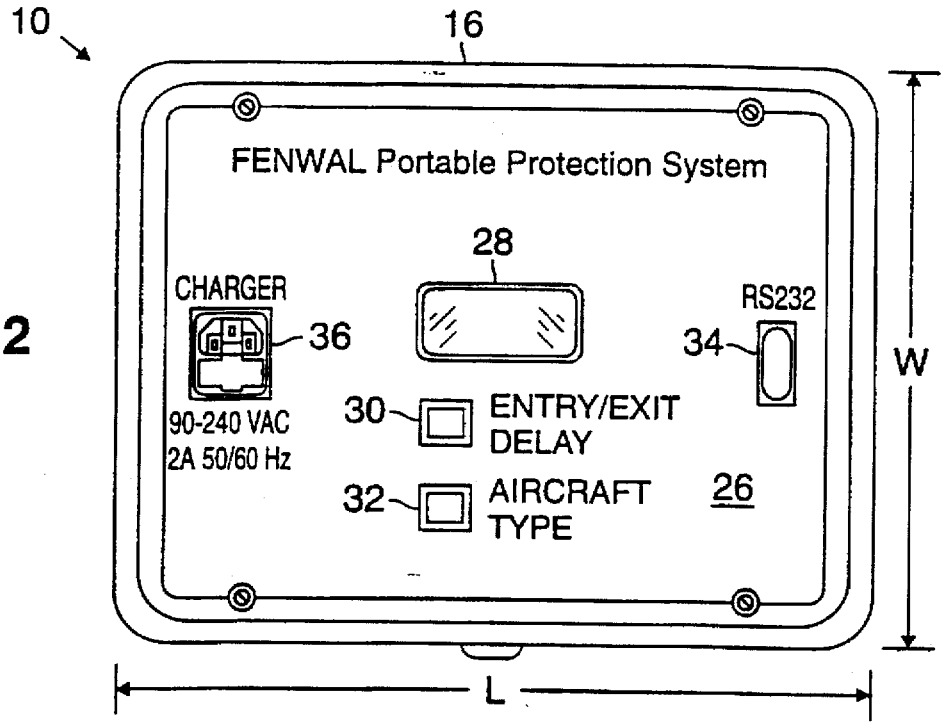
FIG. 2 is a top view of a security system control face.
Figure 3:
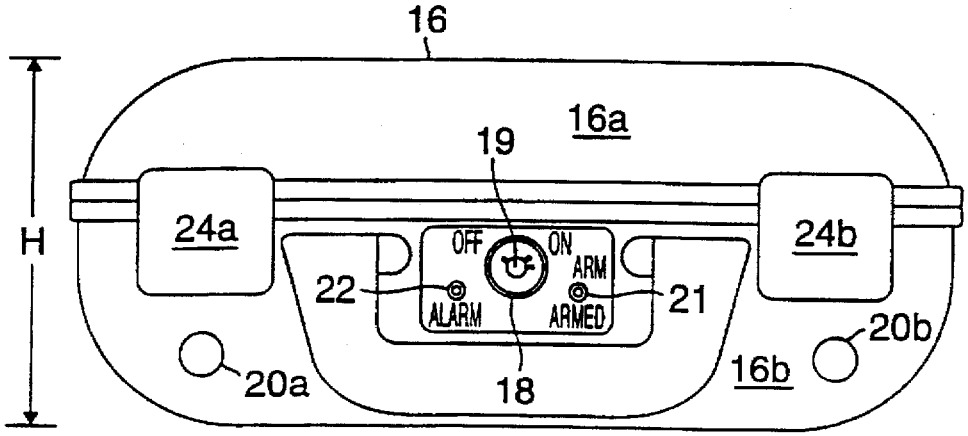
FIG. 3 is a side view of a security system.

Referring to FIGS. 2 and 3, PSS 10 includes a generally rectangular-box shaped housing 16 that is approximately nine inches in width W, twelve inches in length L, and five inches in height H. Housing 16 includes a cover 16*a* and a base 16*b*. Latches 24*a* and 24*b* secure cover 16*a* to base 16*b*.

PSS 10 also includes two air pressure sensors 20*a* and 20*b* and a mode switch 18 having three positions OFF, ON, and ARM. When mode switch 18 is moved to the ARM position using a key 19, an armed LED 21 is illuminated, and when PSS 10 detects an intrusion, an alarm LED 22 is illuminated. After arming the PSS, key 19 may be removed to prevent an unauthorized person from disarming the PSS (i.e., prevent switch 18 from being moved to the OFF or ON positions).

Latches 24*a* and 24*b* may be manipulated to remove cover 16*a* and expose control face 26. Control face 26 includes a liquid crystal display (LCD) 28 for displaying logged events (e.g., possible intrusions) and control and status information. Control face 26 further includes control buttons ENTRY/EXIT DELAY 30 and AIRCRAFT TYPE 32 for modifying and displaying the PSS control and status information and for displaying the logged events. An external communication port, RS232 connector 34, is also provided to allow PSS 10 to communicate with external electronic devices (e.g., computers or printers), and a charging port 36 for receiving a plug to an external AC power source is included to allow a battery (or batteries) within PSS 10 to be re-charged.

Figure 4A:
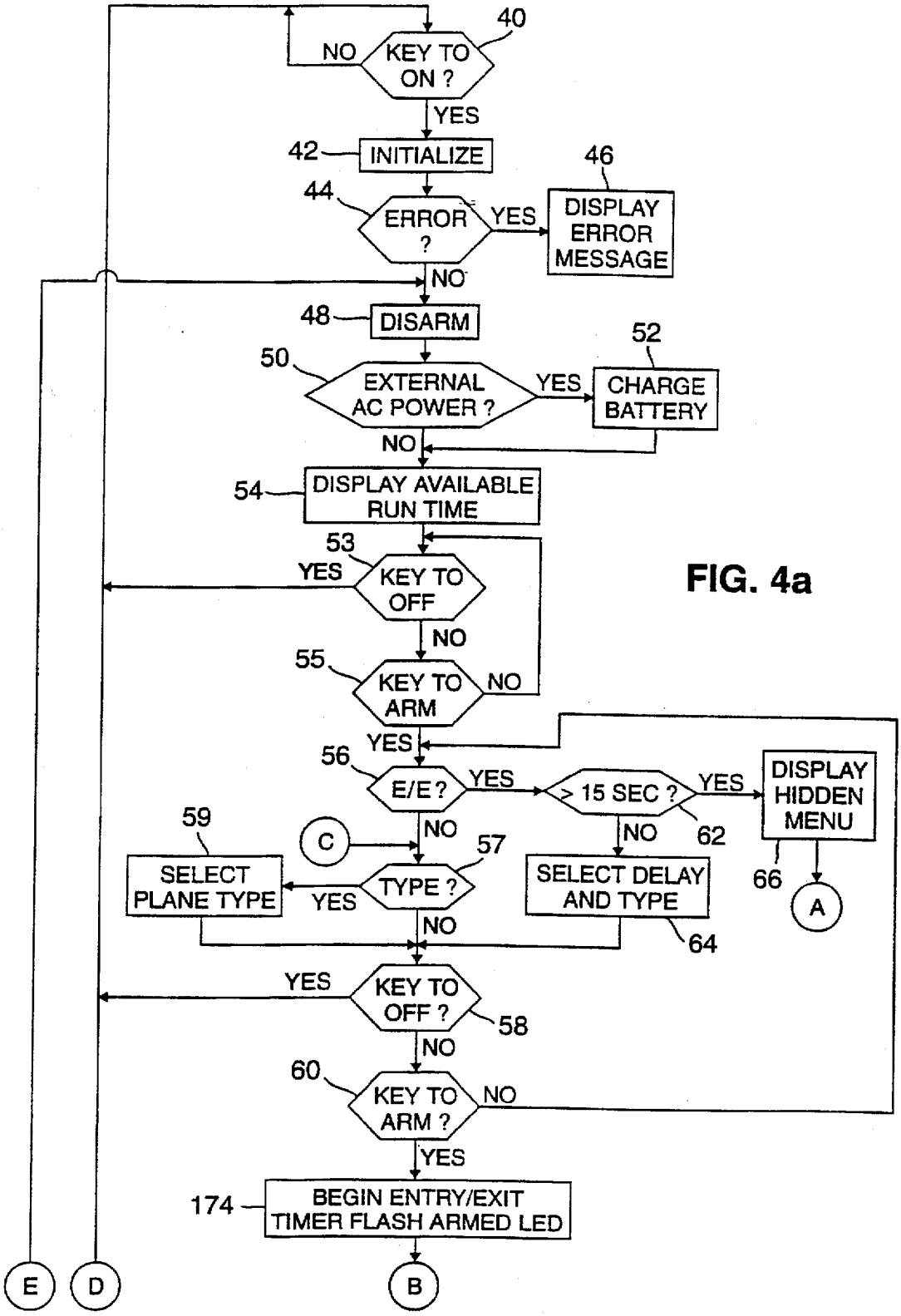
FIGS. 4*a*–4*c* are flow charts describing the operation of the security system of FIGS. 2 and 3.
Figure 4B:
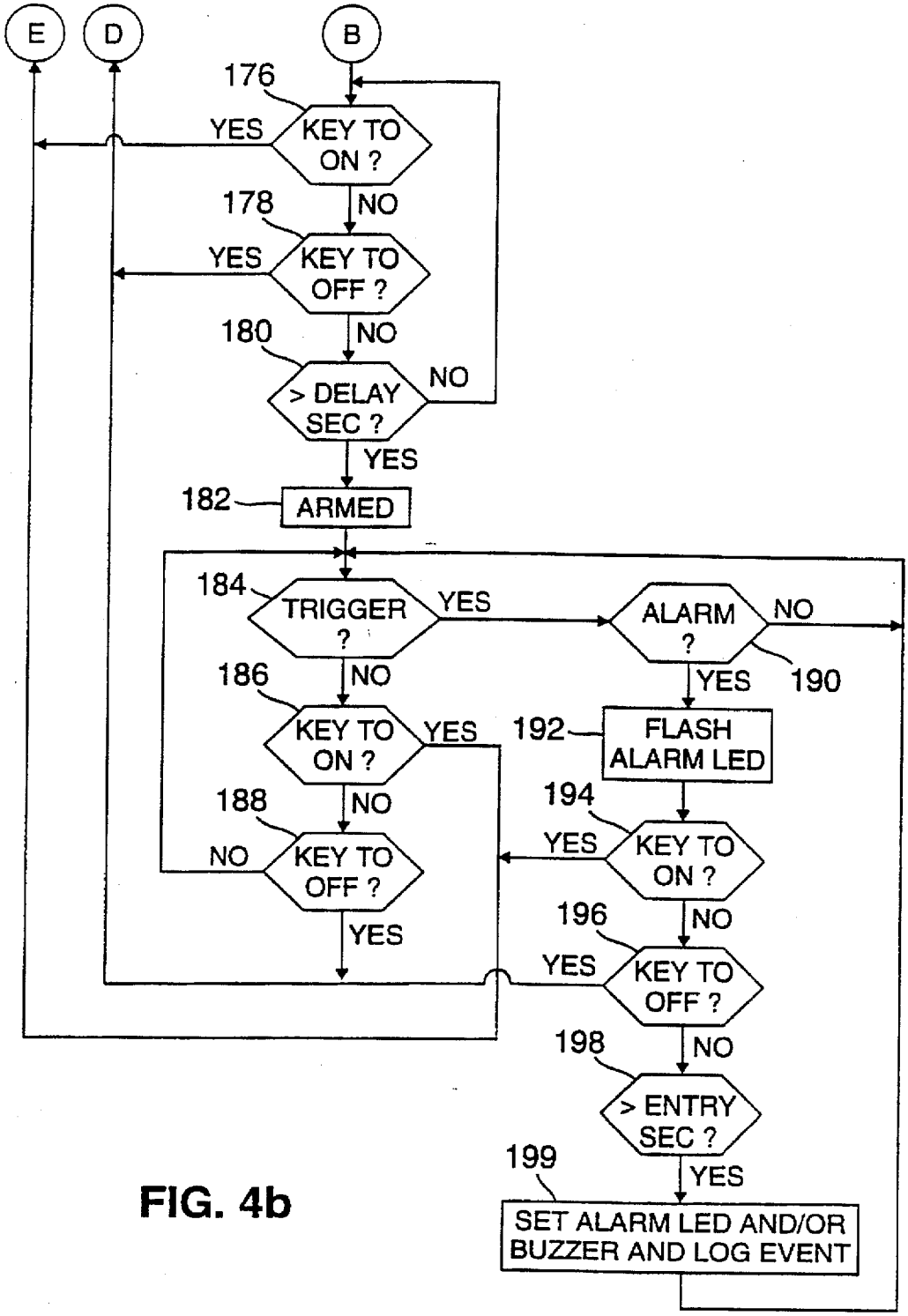
Figure 4C:
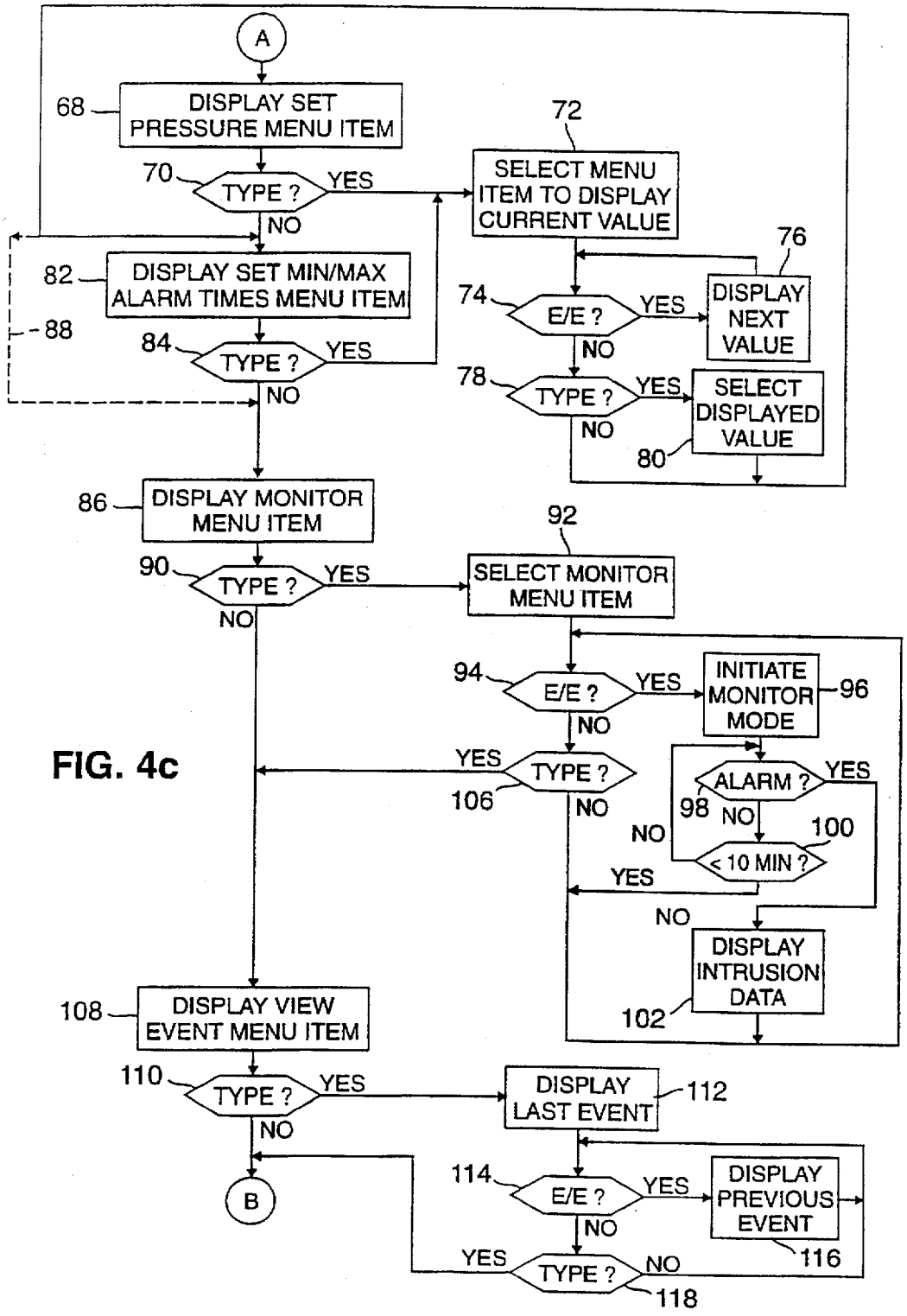
Figure 4D:
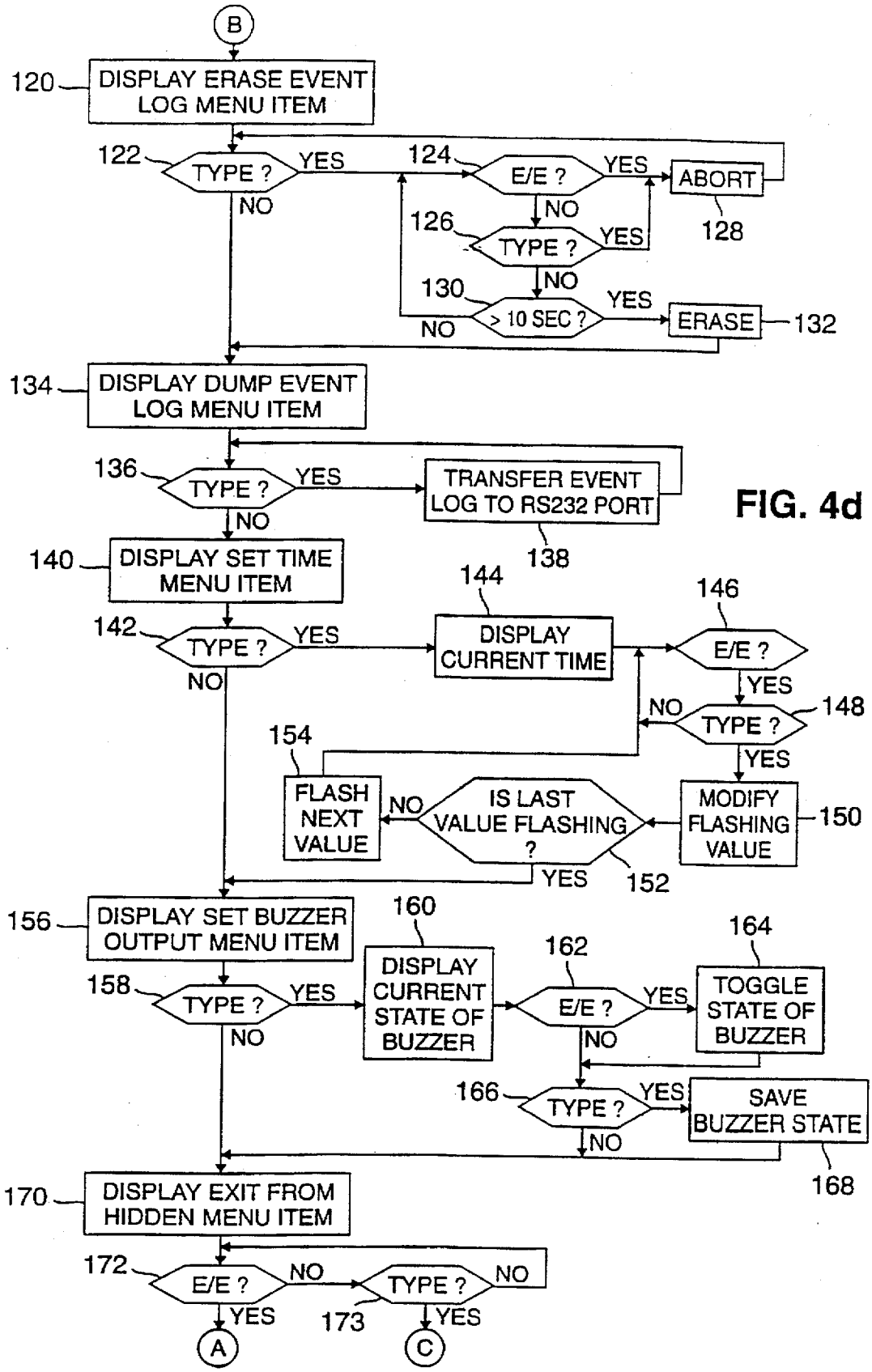

Referring to FIGS. 4*a*–4*c*, when the PSS is to be armed or when the system parameters of the PSS are to be modified, key 19 is first used to turn (step 40) mode switch 18 to the ON position. Once in the ON position, a central processing unit (CPU 39, FIG. 5) within the PSS initializes (step 42) the PSS by running a series of self-tests to, for instance, check that the air pressure sensors are operating and calculate and determine whether the checksum of the data in memory (not shown) within the PSS is correct. If the PSS fails (step 44) the self-tests, then the CPU displays (step 46) an error message on the LCD. If the PSS passes (step 44) the self-tests, then the CPU enters (step 48) a Disarmed state.

In the Disarmed state, the CPU first runs a battery test and displays a battery testing message on the LCD. The CPU then determines (step 50) whether an external AC power supply has been connected to charging port 36 (FIG. 2). If an external AC power source is connected, then the CPU writes a start charging event in the event log and begins temperature compensated charging (step 52) of the batteries. During charging, the CPU monitors, for example, every second (and may display successively) the battery voltage, charger current, PSS temperature, and battery charge (percentage), each of which are averaged readings. If the AC power source is removed during charging, the CPU writes an end charging event in the event log and stops charging the batteries.

To charge the batteries, the CPU first determines the battery capacity. If the battery capacity is at least at 80% capacity, the CPU monitors the battery capacity for four minutes. If the battery capacity is still at least 80%, then the batteries are charged in maintenance mode, otherwise the batteries are charged in full charge mode (3 mode). Once the batteries are fully charged, the PSS has a minimum run time of twelve hours.

In the maintenance mode of charging, the battery voltage is varied based on the current battery capacity (temperature compensated). If the battery voltage falls below 80% of the battery capacity, then the CPU begins charging the battery in full charge mode.

In the full charge mode of charging, the battery voltage is varied to maintain the charger at a fixed current of, for example, 1 amp until the battery reaches a "top off" voltage specified by the manufacturer and dependant upon the temperature of the PSS. The CPU will maintain the battery at the top off voltage for twenty minutes (specified by the manufacturer to prevent damage). At the end of twenty minutes, the battery is fully charged and the CPU switches to charging in maintenance mode until the external AC power source is removed. The full charge mode is a "smart charging mode" and is currently the fastest available charging scheme.

Once the battery is charged, the CPU displays (step 54, FIG. 4*a*) the available battery run time, derived from the available battery capacity, on the LCD. The CPU then remains in the Disarm state until the key is used to move the mode switch to the OFF or ARM position (steps 53 and 55).

Once the mode switch is moved to the ARM position, the CPU determines (step 56) whether the ENTRY/EXIT DELAY (E/E) button 30 (FIG. 2) is pressed. If not, then the CPU determines (step 57) whether the type button is pressed. If the type button is pressed, then the CPU selects (step 59) the aircraft type being displayed on the LCD. If the type button is not pressed, then the CPU determines (step 58) whether the key has moved the mode switch to the OFF position. If the key has moved the mode switch to the OFF position, then the CPU returns to step 40 and waits for the key to turn the mode switch to the ON position. If the key has not moved the mode switch to the OFF position, then the CPU determines (step 60) whether the key has moved the mode switch to the ARM position. If the key has not moved the mode switch to the ARM position, then the CPU repeats steps 56–60 until either the E/E button or the type button is pressed or the key turns the mode switch to the OFF or ARM positions.

If the CPU determines (step 56) that the E/E button has been pressed, then the CPU determines (step 62) whether the E/E button has been pressed (i.e., continuously held down) for longer than 15 seconds. If the E/E button has not been held down 15 seconds, then the CPU displays a first preset entry/exit delay time. The user may then toggle the E/E button to display other preset entry/exit delay times and when the desired selection is displayed in the LCD, then the user can press the AIRCRAFT TYPE (type) button 32 (FIG. 2) to select (step 64) the displayed entry/exit delay time. The CPU then displays a first preset aircraft type. The user may again toggle the E/E button to display other aircraft types and when the desired selection is displayed in the LCD, then the user can press the type button to select (step 64) that preset aircraft type and the PSS preset parameters associated with that aircraft type.

If the user wants to modify PSS parameters for one or more of the aircraft types or view the events log or take parameter measurements from within a particular airplane, then the user holds the E/E button for greater than 15 seconds to enter the PSS hidden menu. When the CPU determines (step 62) that the E/E button has been pressed for greater than 15 seconds, then the CPU displays (step 66) the hidden menu by scrolling through menu items.

The CPU first displays (step 68) a Set Pressure menu item and determines (step 70) if the type button (32, FIG. 3) has been pressed. If the type button has been pressed, then the user has selected the Set Pressure menu item and the CPU displays (step 72) the current pressure threshold value ($P_{TH}$, described below). The user can then press the E/E button to scroll through other available pressure threshold values (steps 74 and 76). When the desired pressure threshold value is displayed, the user presses the type button to select the displayed pressure threshold (steps 78 and 80).

After displaying the Set Pressure menu item, the CPU displays (step 82) the Set Min/Max menu item. The user again presses the type button (step 84) to select the Set Min/Max menu item, and the user can select new Min/Max values ($t_{min}$ and $t_{max}$, described below) in the manner (steps 72–80) described for selecting a pressure threshold except that after the Min/Max values are set, the CPU displays (step 86) the Monitor menu item (dashed line 88).

The user presses the type button to select the Monitor menu item (steps 90 and 92) when the user wants to measure PSS parameters associated with intrusions (e.g., opening a door) into a particular aircraft. Once selected, the CPU determines (step 94) whether the E/E button has been pressed. If so, the CPU initiates (step 96) monitor mode and determines whether an intrusion has been detected within 10 minutes (steps 98 and 100). The user causes an alarm by intruding into the plane (e.g., opening a door or walking through the cabin). The thresholds ($P_{TH}$, $t_{min}$, and $t_{max}$) for the PSS are set at a minimum to detect even very small, for example, 0.2 μbar, pressure changes. After detecting the intrusion, the CPU displays (step 102) the measured intrusion data (e.g., $P_W$, $P_H$, $P_L$, $t_{pp}$, $M_{RT}$, described below) and causes an event logging circuit 197 (FIG. 5) to write the intrusion event to an event log 201 stored in memory 220. If the CPU does not detect an intrusion within 10 minutes, then the CPU returns to step 94.

After displaying the intrusion data, the CPU also returns to step 94 and again determines whether the E/E button has been pressed indicating that the user wants to monitor another intrusion. If so, steps 96–102 are repeated, and if not, the CPU determines (step 106) whether the type button has been pressed to abort monitor mode. If the type button has not been pressed, then the CPU repeats steps 94 and 106 until either the type button or the E/E button are pressed. If the type button has been pressed, then the CPU exits Monitor mode and displays (step 108) the View Event menu item.

The user presses the type button while the View Event menu item is displayed to select (step 110) the View Event menu item and the CPU displays (step 112) the last logged event. The user can then press the E/E button to toggle through previously logged events and the type button to abort the View Event menu item (steps 114–118).

After the View Event menu item, the CPU displays (step 120) the Erase Event Log menu item and the user selects (step 122) this menu item by pressing the type button. If selected, the user has 10 seconds within which to press the E/E button and/or the type button to abort the erase procedure (steps 126–128). If the CPU determines (step 130) that neither the E/E button nor the type button were pressed within 10 seconds, then the CPU erases (step 132) the events log.

The CPU then displays (step 134) the Dump Event Log menu item. If the user selects (step 136) the Dump Event Log menu item, then the CPU transfers (step 138) the data from the events log to the RS232 port 34 (FIG. 2) and through a connector (not shown) to an external computer or printer (not shown).

The CPU next displays (step 140) the Set Time menu item. The user selects (step 142) the Set Time menu item to modify a real time clock (not shown) within the PSS. Once selected, the CPU displays (step 144) the current time (MM DD YY HH min—month day year hour minute) and causes the LCD to flash the first value to be modified, for example the month (MM). The user presses (step 146) the E/E button to toggle through the available values for the flashing value and presses (step 148) the type button to select the new value and cause the CPU to modify (step 150) the flashing value. The CPU then determines (step 152) whether the last value is flashing, for example, minute (min). If not, the CPU flashes (step 154) the next value and returns to step 146, and if so, the CPU displays (step 156) the Set Buzzer Output menu item.

If the user selects the Set Buzzer Output menu item by pressing (step 158) the type button, the CPU displays (step 160) the current state (enabled or disabled) of the PSS buzzer (not shown). The user may then press (step 162) the E/E button to toggle between the different buzzer states while the CPU displays (step 164) the toggled value. The user may then press (step 166) the type button to select the displayed buzzer state and to cause the CPU to save (step 168) the current buzzer state.

The CPU then displays (step 170) the Exit From Hidden menu item. If the user presses (step 172) the E/E button, then the CPU returns to step 68 and displays the first menu item Set pressure. If the user presses (step 173) the type button, then the CPU returns to determining whether the E/E button has been pressed or whether the key has been used to move the mode switch to the OFF or ARM position (steps 56–60).

Figure 5:
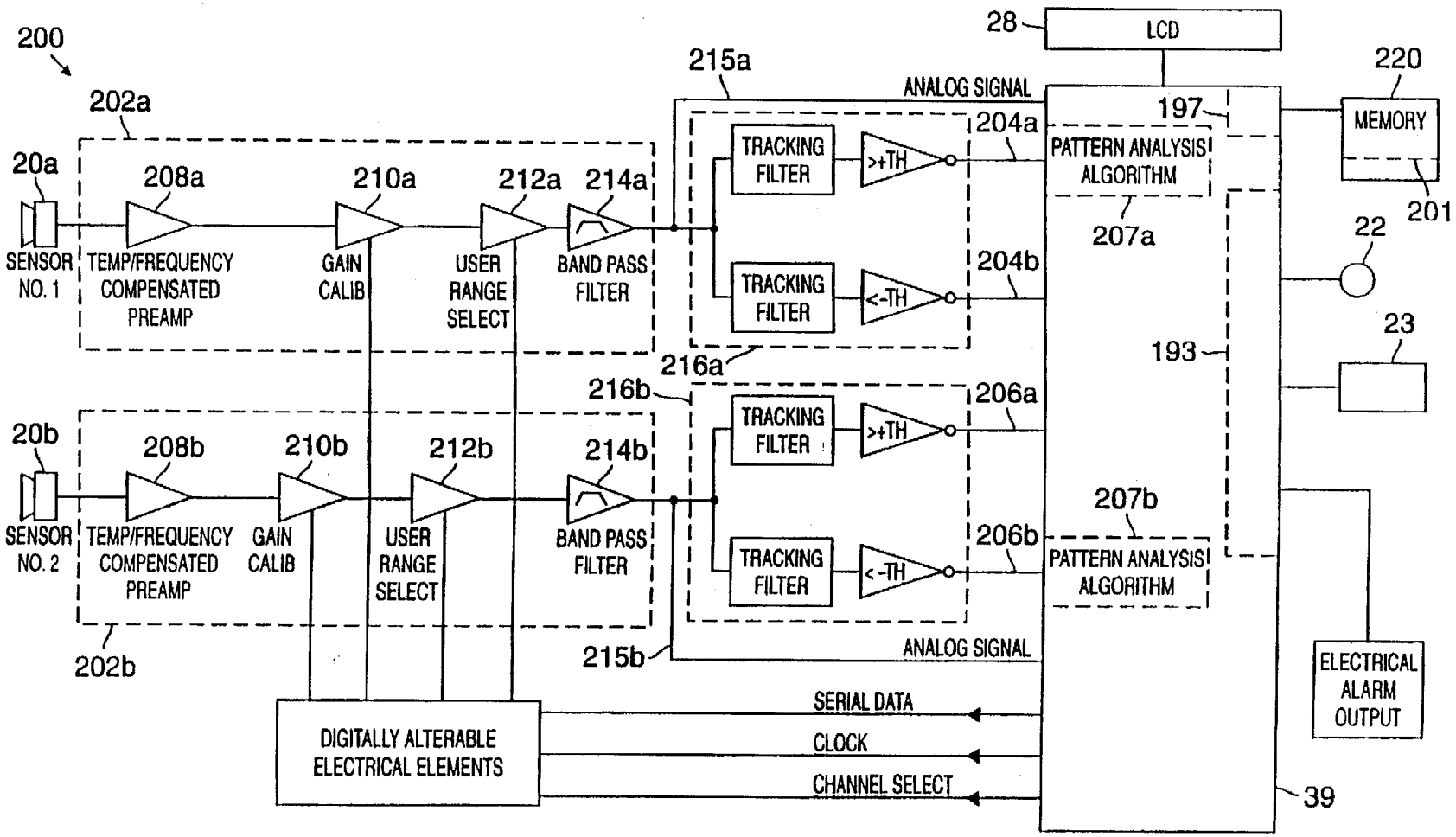
FIG. 5 is a block diagram of a portion of the internal circuitry of the security system of FIGS. 2 and 3.

Any time after initialization, the user can use key 19 (FIG. 3) to move mode switch 18 to the OFF position or the ARM position. Once the CPU determines (step 60) that the mode switch is in the ARM position, the CPU starts (step 174) the entry/exit delay timer and flashes ARMED LED 21. The delay timer depends upon the aircraft type and is set to a value which allows the user to arm the PSS and exit the aircraft. As an example, a Boeing 737 has a large entry/exit delay of eight minutes because Boeing 737s have airstair doors that require additional time to exit and reseal. While the CPU waits for the entry/exit time delay to run (step 180), the CPU determines (steps 176 and 178) whether the key has moved the mode switch to the ON or OFF position, and, if so, returns to step 48 and disarms the PSS. If the key has not moved the mode switch to the ON or OFF position and the entry/exit delay timer runs down, the CPU causes (step 182) the armed LED to stop flashing and continuously illuminate while enabling the alarm detection circuitry 200 (FIG. 5, described below).

Once the PSS is armed, the CPU shuts down (sleeps) and waits (step 184) for a trigger signal, described below, indicating a possible intrusion. If at any time the key moves (steps 186 and 188) the mode switch to the ON or OFF positions, the CPU returns to step 48 and disarms the PSS.

If the CPU detects (step 184) a trigger signal, then the CPU "wakes up" and determines (step 190, described below) whether the air pressure changes causing the trigger signal represent an actual intrusion. If the air pressure changes do not represent an intrusion, the CPU again sleeps and returns to step 184 to wait for another trigger signal. If the air pressure changes causing the trigger signal do represent an actual intrusion, then the CPU starts (step 192) the entry/exit delay timer and a notification circuit 193 (FIG. 5) within the CPU flashes the alarm LED.

While the entry/exit delay timer is running, the CPU determines (steps 194 and 196) whether the key has moved the mode switch to the ON or OFF position. If the mode switch has been moved to the ON or OFF position, an event logging circuit 197 (FIG. 5) within the CPU does not log an alarm and returns to steps 42 and 40, respectively. If the key does not move the mode switch to the ON or OFF position before the entry/exit delay timer has run (step 198), then the CPU causes (step 199) the notification circuit to stop flashing and continuously illuminate the alarm LED 22 (FIG. 3) and/or cause a buzzer 23 (FIG. 5) to generate an alarm sound. The CPU also causes the event log circuit to log the alarm in an event log 201 in memory 220.

When an operator returns to the PSS to determine whether an intrusion was detected, if the alarm LED is flashing while the operator is approaching the PSS to disarm it, then no intrusion was detected. The flashing LED indicates to the operator that only the operator's recent entry into the plane has been detected since the operator armed the PSS. Conversely, if the operator sees a solid alarm LED, then the operator knows that an intrusion, aside from his/her own recent entry, was detected since the time that the PSS was armed.

Referring to FIG. 5, alarm detection circuitry 200 includes air pressure sensors 20*a* and 20*b* (FIG. 3), air pressure sensing circuits 202*a* and 202*b*, trigger circuits 216*a* and 216*b*, and a CPU 39. The air pressure sensors are microphones and may be of the type, WM-52B, manufactured by Panasonic, Corp. The air pressure sensors and trigger circuits are independent, dual redundant systems, such that if one fails, the PSS will continue to detect intrusions. Thus, only one air pressure sensor and one trigger circuit is required. The air pressure sensing circuits 202*a* or 202*b* and trigger circuits 216*a* and 216*b* monitor the electrical signals generated by air pressure sensors 20*a* and 20*b*, respectively. If either electrical signal meets a predetermined condition (described below), then the trigger circuits send one or more wake up signals 204*a*, 204*b*, 206*a*, or 206*b* to a digital signal processor circuit 207*a* or 207*b*, respectively, within the CPU to initiate signal processing.

Figure 6A:
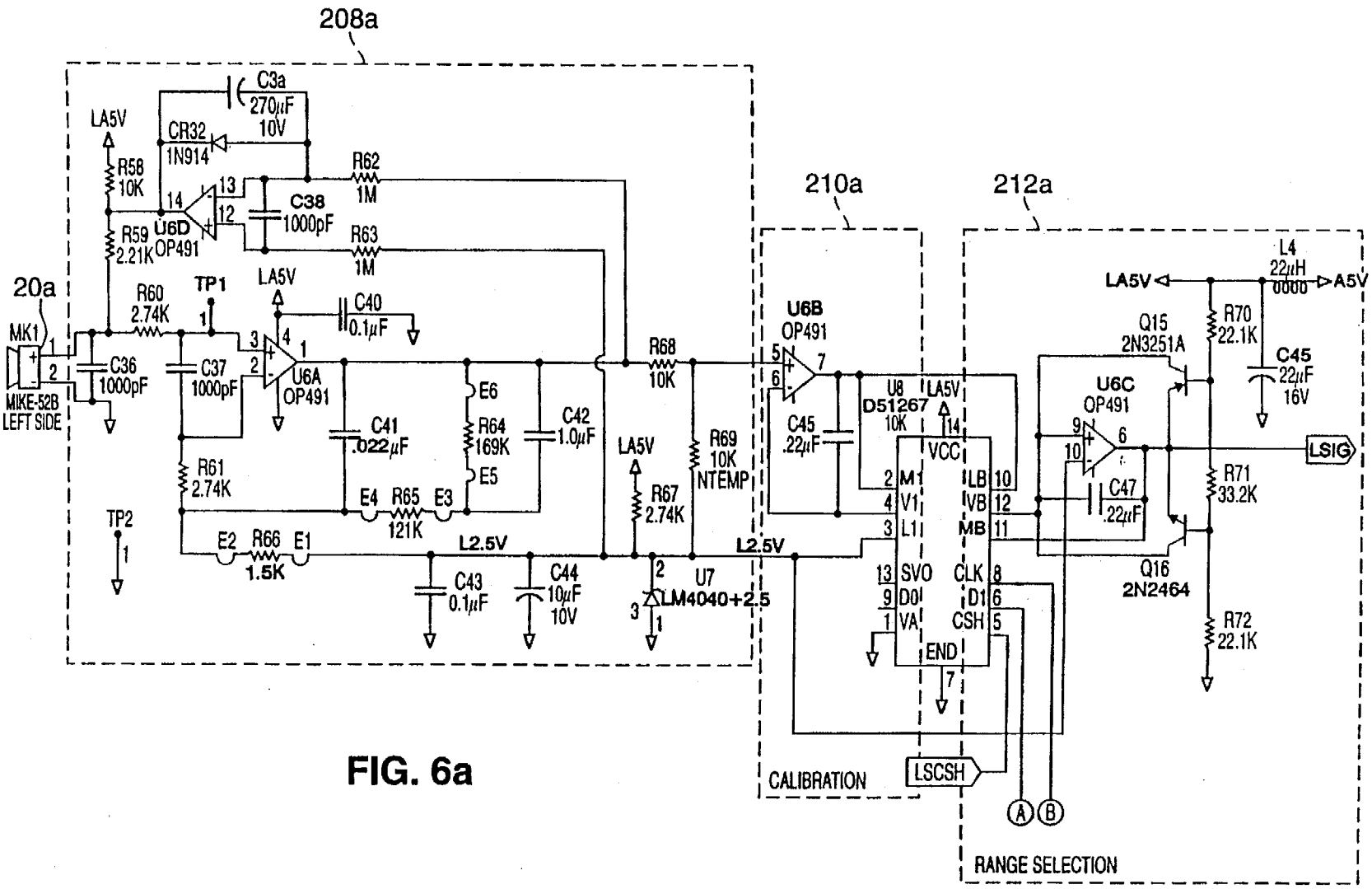
FIGS. 6*a* and 6*b* are schematic diagrams of the internal circuits of FIG. 5.
Figure 6B:
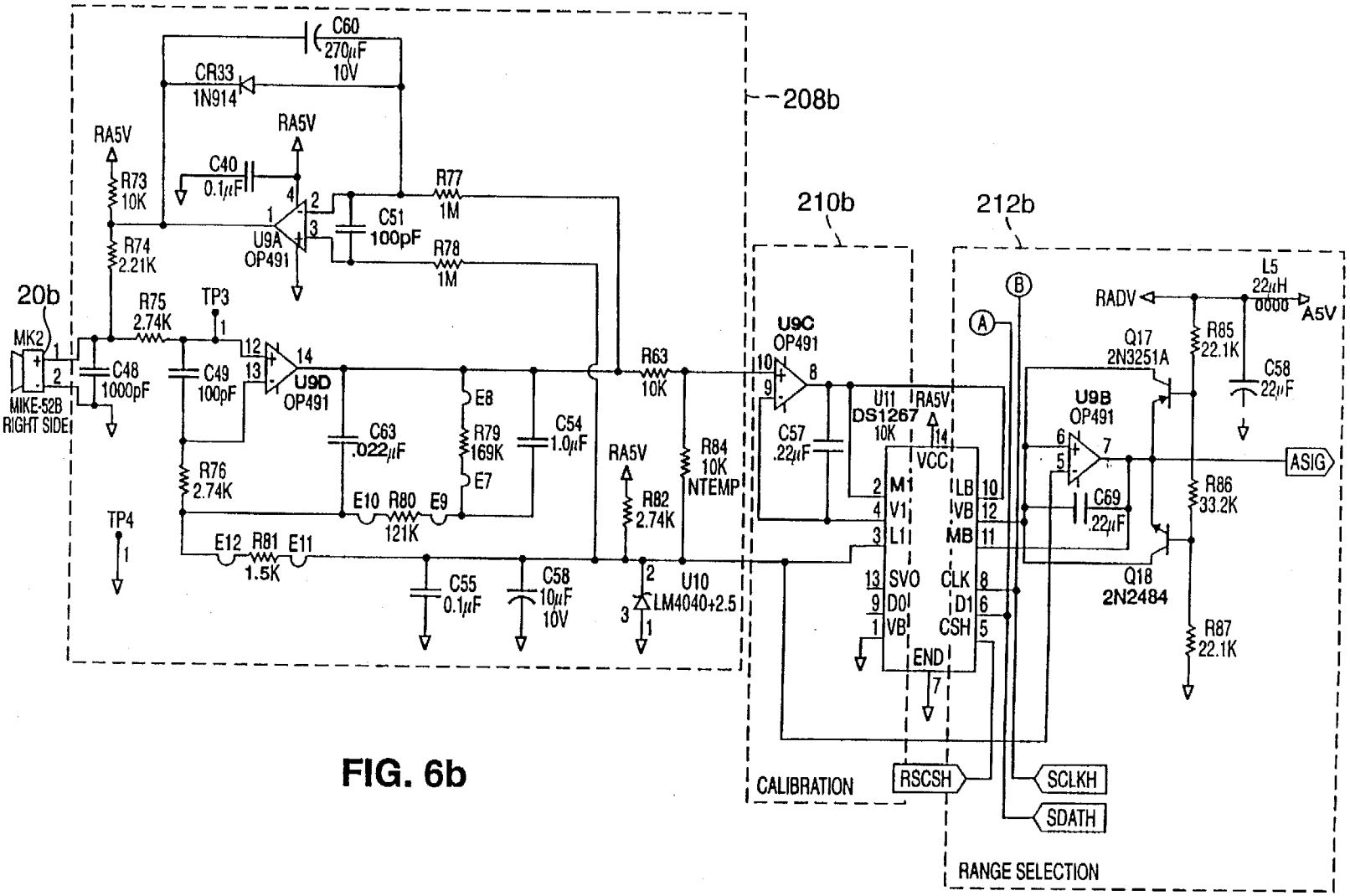
Figure 6C:
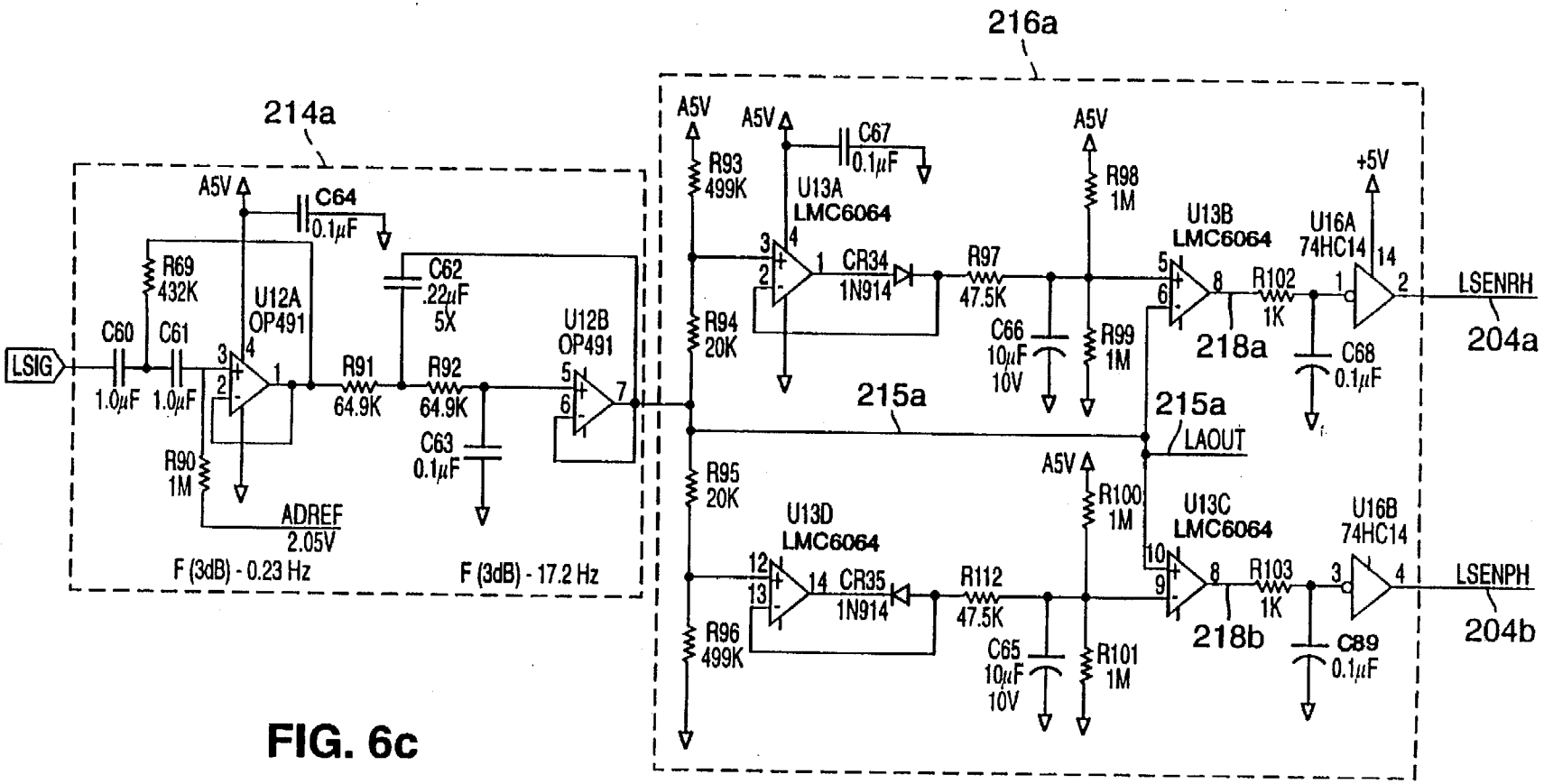
Figure 6D:
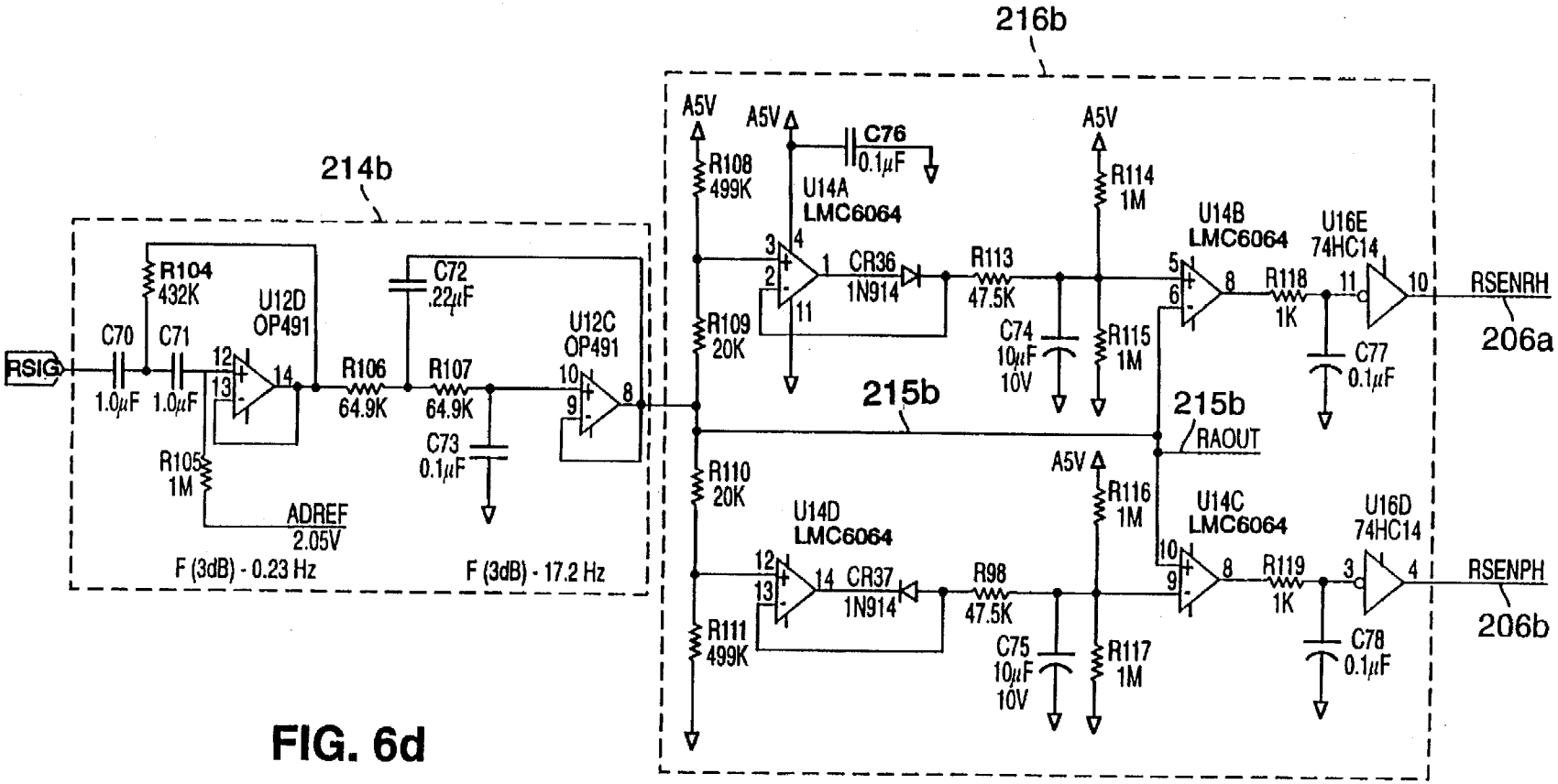

Referring also to FIGS. 6*a* and 6*b*, input amplifier circuits 208*a* and 208*b* condition the electrical signals from air pressure sensors 20*a* and 20*b*, respectively, to provide temperature and frequency compensation. The input amplifier circuits are identical, and, as an example, input amplifier circuit 208*a* is described. To reduce signal distortion, circuit 208*a* provides a flat frequency response for signals in a frequency range of about 2–10 Hz. The resistive values R64, R65, and R66 vary for different types of air pressure sensors (e.g., different microphones). Thus, different types of air pressure sensors are tested to determine which values of R64, R65, and R66 provide a flat frequency response. Resistor R68 and negative temperature coefficient thermistor R69 provide temperature compensation. As the temperature increases, the resistance of R69 decreases to compensate for changes, due to temperature, in the response of air pressure sensor 20*a*.

Air pressure sensing circuits 202*a* and 202*b* also include identical, adjustable gain calibration circuits 210*a* and 210*b*, respectively. Gain calibration circuit 210*a* is described. CPU 39 downloads a calibration value into a dual digital potentiometer U8. The left half outputs of U8 use the calibration value to set the gain of operational amplifier (op-amp) U6B to achieve a 20 mv/μbar output voltage. The calibration value is obtained by testing the air pressure sensing circuits and determining the calibration value that provides a 20 mv/μbar output voltage at the output of op-amp U6B.

Air pressure sensing circuits 202*a* and 202*b* further include identical, adjustable μbar range select circuits 212*a* and 212*b*, respectively. Select circuit 212*a* is described. CPU 39 down-loads a pressure threshold $P_{TH}$ value (in accordance with a user selected plane type or in accordance with a user modified value) to dual digital potentiometer U8. The right half outputs of U8 use the pressure threshold value to set the gain of operational amplifier (op-amp) U6C such that if the air pressure detected by air pressure sensor 202*a* is equal to the pressure threshold, U6C generates a 100 mv output signal.

Prior to sending the electrical signals from the μbar range select circuits to the CPU, air pressure sensing circuits 202*a* and 202*b* pass the signals through band pass filter circuits 214*a* and 214*b*, respectively. Band pass filter circuit 214*a* is described. Op-amps U12A and U12B pass electrical signals having a frequency within a frequency range of about 0.23–17.2 Hz. This wide frequency range insures that even extreme changes in air pressure caused by, for example, a very slow or fast opening door are detected. This frequency range also excludes some very low frequency signals caused by the wind.

The output signals LAOUT 215*a* and RAOUT 215*b* of the band pass filters are passed directly to an analog-to-digital (A/D) converter within CPU 39 before being passed to digital signal processors 207*a* and 207*b*, respectively. LAOUT 215*a* and RAOUT 215*b* are also passed to identical trigger circuits 216*a* and 216*b*, respectively. Trigger circuit 216*a* is described. Op-amps U13A and U13B detect positive changes in LAOUT 215*a*, while op-amps U13C and U13D detect negative changes in LAOUT 215*a*. To prevent false triggers, the negative changes in LAOUT 215*a* are not inverted into positive changes. Inversion may distort the signal by causing a positive change to be combined with an inverted negative change resulting in a large positive change and a false trigger.

As ambient noise increases or decreases, e.g., a change in the wind, an approaching storm system, or a nearby, hovering helicopter, the combinations of op-amp U13A and diode CR34 and op-amp U13D and diode CR35, respectively, charge threshold capacitors C65 and C66, respectively. As a result, the threshold established by capacitor C65 floats to a level 100 mv above the ambient noise and the threshold established by capacitor C66 floats to a level 100 mv below the ambient noise. C65 and C66 cannot be quickly charged by a large change in LAOUT 215*a*. Thus, if a quick change in LAOUT 215*a* is greater than 100 mv, then trigger signals 218*a* and/or 218*b*, respectively, are asserted.

The combinations of resistor R102 and capacitor C68 and resistor 103 and capacitor 69 stretch the duration of the output 218*a* of U13B and the output 218*b* of U13C, respectively, to at least 1–2 ms. The increase in signal duration insures that trigger signals 204*a* or 204*b*, respectively, will have a duration sufficient to trigger CPU 39 and initiate signal processing.

Once triggered, the digital signal processing circuits 207*a* and/or 207*b* within CPU 39 begins sampling signals LAOUT 215*a* and RAOUT 215*b* (the analog signals representing changes in air pressure) every 1 ms and storing the sampled data in a memory unit 220. Simultaneously, CPU 39 measures the pulse width (PW) of the triggering signal (204*a*, 204*b*, 206*a*, or 206*b*, FIG. 5). If the pulse width does not exceed a pulse width threshold ($t_{min}$, approximately 10–140 ms depending upon the aircraft type), then the CPU causes the digital signal processing circuits to stop sampling, goes back into sleep mode, and waits for another trigger signal. If the pulse width does exceed $t_{min}$, then the digital signal processing circuits continue to sample data until either the CPU detects an alarm or a time period equal to three times $t_{max}$ passes before an alarm is detected. If the time period passes without an alarm, the CPU causes the digital signal processing circuits to stop sampling, goes back into sleep mode, and waits for another trigger.

For each trigger signal the CPU receives, to detect an alarm, the CPU processes the data sampled from LAOUT 215*a* and/or RAOUT 215*b* to determine if the signals match patterns typical of intrusions (i.e., intrusion patterns). There may be many different patterns associated with intrusions. As examples, two alarm types (i.e., two patterns) are discussed; type 1 and type 2. A type 1 alarm occurs when, for example, a door (cabin or cargo) is opened normally or very slowly, while a type 2 alarm occurs when, for example, a door is opened very quickly.

Figure 7:
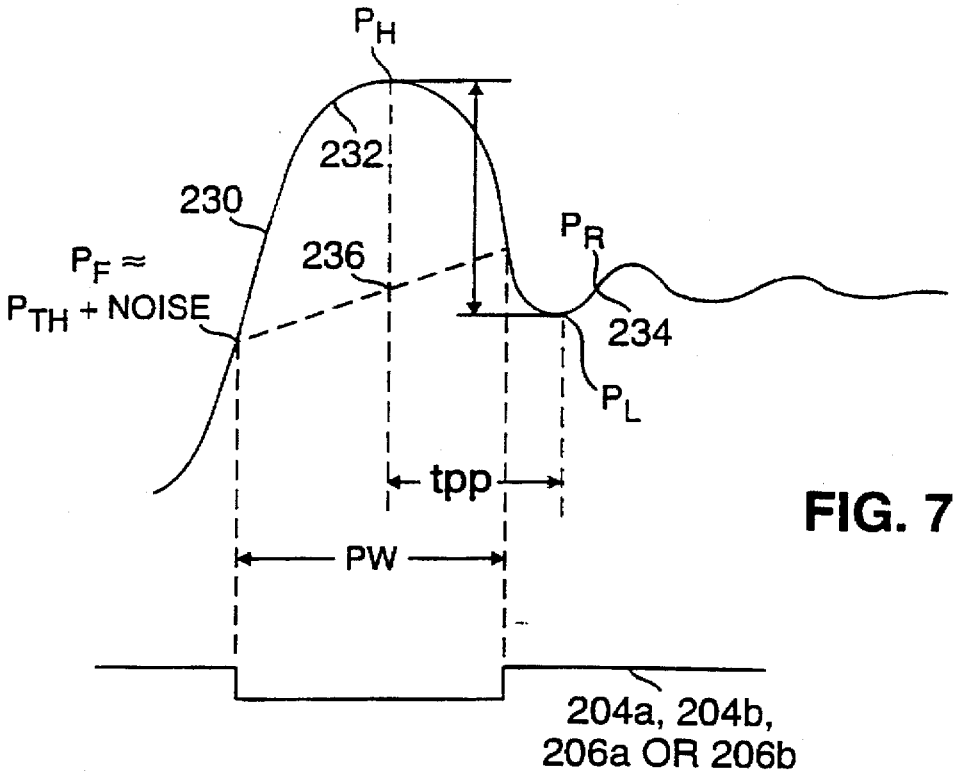
FIG. 7 shows an intrusion pattern.

Referring to FIG. 7, the signals generated by the air pressure sensors for a type 1 alarm will generally match the shape of signal 230 (i.e., a damped sine wave). The amplitude and pulse width may vary but the overall shape, a large intrusion (positive or negative) peak 232 followed by a small recovery (positive or negative) peak 234, will remain substantially the same. Signal 230 first rises above the floating threshold PF (approximately pressure threshold $P_{TH}$+noise) established by trigger circuits 216*a* or 216*b*. Because the signal 230 continues to rise, the floating threshold also rises as indicated by dashed line 236. Signal 230 then rises to a maximum amplitude $P_H$ before falling to minimum amplitude $P_L$ and rising to a recovery amplitude $P_R$ (approximately 0.3 times $P_{TH}$ above or below $P_L$).

In order to detect a type 1 alarm, five conditions must be met. First, $P_H$ must occur within the PW time period. Second, the PW of the trigger signal must be greater than $t_{min}$ and less than $t_{max}$:

$$t_{min}<PW<t_{max}.$$

Third, the intrusion peak 232 must be sufficiently large. For example, the absolute value of $P_H$ minus $P_L$ must be greater than two times the pressure threshold $P_{TH}$:

$$|P_H-P_L|>(2)\ (P_{TH}).$$

Fourth, the recovery peak 234 must be sufficiently large, and $P_R$ must be detected within the maximum evaluation period ($t_{max}$). For example, the absolute value of $P_R$ minus $P_L$ must be greater than 0.3 times $P_{TH}$:

$$|P_R-P_L|>(0.3)\ (P_{TH}).$$

Fifth, the peak-to-peak time $t_{pp}$ (i.e., the time between $P_H$ and $P_L$) must be greater than $t_{min}$ and less than a maximum time defined, for example, by:

$$t_{pp}<[1.35+|(P_H-P_F)\div(P_H-P_L)|]*\ (t_{max}).$$

Generally, $t_{pp}$ must be less than $t_{max}$. However, when $P_H$ is substantially larger than $P_F$, signal 230 needs increased time to recover $P_R$. In this case, an alarm is still detected although $t_{pp}$ exceeds $t_{max}$, as long as:

$$t_{pp}<[1.35+|(P_H-P_F)\div(P_H-P_L)|]*(t_{max}).$$

Although changes in the wind may result in pressure changes that cause the air pressure sensors to generate an electrical signal having a shape similar to signal 230, $t_{pp}$ for such a signal is generally too large to cause an alarm.

Figure 8:
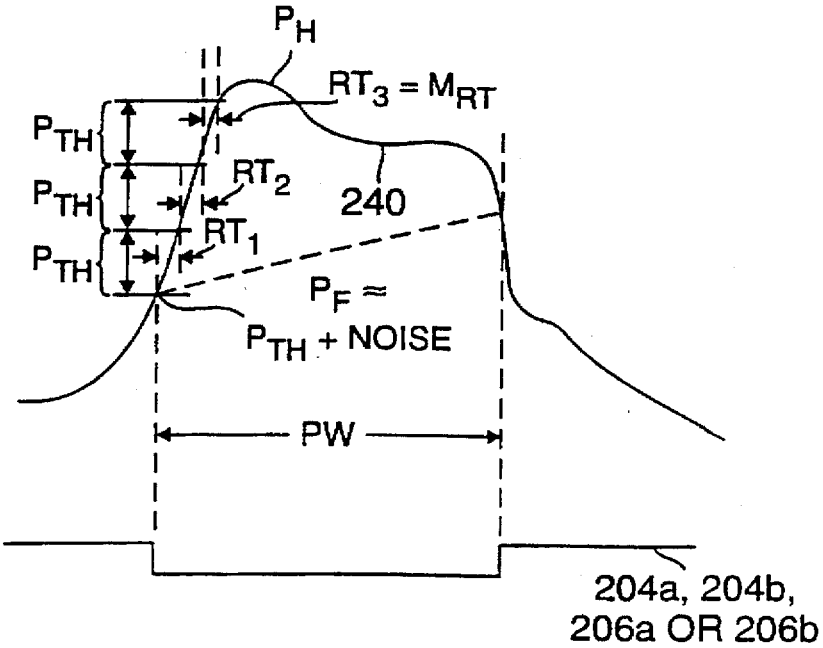
FIG. 8 shows another intrusion pattern.

Referring to FIG. 8, the signals generated by the air pressure sensors for a type 2 alarm generally match the shape of signal 240 (i.e., a quickly increasing or decreasing signal with a wide pulse width). In order to detect a type 2 alarm, three conditions must be met. First, $P_H$ must occur within the pulse width PW time period. This avoids detecting an alarm for a continuous increase or decrease in pressure caused, for example, by a helicopter hovering nearby or by an incoming storm system. Second, the pulse width must be greater than 0.8 times $t_{max}$:

$$PW>(0.8)\ (t_{max}).$$

To reduce the possibility of missing an intrusion, there is some overlap between the type 1 and type 2 alarms when PW is:

$$(0.8)\ (t_{max})<PW<t_{max}.$$

Thus, certain signals from the air pressure sensors may cause both a type 1 and a type 2 alarm.

The third condition depends on how fast the pressure increases, as determined by the maximum measured rise time $M_{RT}$. The maximum measured rise time is determined by measuring the time required for signal 240 to change an amount equal to $P_{TH}$ above or below $P_F$ as signal 240 approaches $P_H$. As shown, the maximum measured rise time $M_{RT}$ is equal to $RT_3$. The third condition requires that $M_{RT}$ be less than or equal to $P_{TH}$ divided by 250 μbars/sec:

$$M_{RT}\leqq P_{TH}\div 250\ \mu bars/sec.$$

Generally a small plane will have a relatively large pressure threshold such as 10 μbars because an intrusion, for instance, opening a door, typically results in a large pressure change. For a pressure threshold of 10 μbars, $M_{RT}$ must be less than or equal to 40 ms. Generally a large plane will have a relatively small pressure threshold such as 0.2 μbars because some intrusions, for instance, opening a portion of a cargo door, typically result in only a small pressure change. For a pressure threshold of 0.2 μbars, $M_{RT}$ must be less than or equal to 0.8 ms.

The band pass filters 214*a*, 214*b* cannot pass a signal with a rise time of 0.8 ms and the analog-to-digital converter in CPU 39 cannot resolve such a fast signal. The resulting signal that is passed through the band pass filter will have a rise time of greater than or equal to 8 ms. Thus, $M_{RT}$ must be less than or equal to $P_{TH}$ divided by 250 μbars/sec unless $P_{TH}$ divided by 250 μbars/sec is less than 8 ms. Where $P_{TH}$ divided by 250 μbars/sec is less than 8 ms, $M_{RT}$ must be greater than or equal to 8 ms.

Once an alarm (type 1 or 2) is detected, CPU 39 (FIG. 5) causes notification circuit 193 to flash alarm LED 22 until key 19 (FIG. 3) is used to turn mode switch 18 to the OFF or ON positions or until the exit/entry delay timer expires. If the exit/entry delay timer expires, the CPU causes the notification circuit to stop flashing and continuously illuminate alarm LED 22. The CPU also causes event logging circuit 197 to write the alarm event to event log 201 in memory unit 220. Optionally, the notification circuit may also cause buzzer 23 to generate an alarm tone.

Other embodiments are within the scope of the following claims.

For example, although the PSS (portable security system) was described with respect to an airplane, the PSS may be used in any enclosed area including homes, yachts, and businesses. Furthermore, the security system may be built into the enclosed area to be monitored, and, thus, need not be portable.

Air pressure sensors 20*a* and 20*b* may be directly connected to analog-to-digital input pins of CPU 39 such that CPU 39 continuously monitors the signals generated by the sensors to detect intrusions. Continuous monitoring, as opposed to monitoring only after being triggered by trigger circuits 216*a* and 216*b*, requires additional power. Larger batteries may be required to support the PSS for a minimum of 12 run-time hours, or the PSS may be directly connected to an available power source.

Additionally, a combination of air pressure sensing circuit 202*a* and trigger circuit 216*a* may be used as the intrusion detector without additional signal processing from CPU 39.

Because many of the capabilities of the PSS are controlled by software that the CPU executes, new capabilities or modifications to capabilities may be easily made by downloading new software through RS232 port 34 (FIG. 2). For instance, new patterns for intrusion detection may be downloaded, the type of events to be logged may be modified, and the data to be gathered in monitor mode may be modified. Similarly, the software may be updated to calculate the actual threshold ($P_{TH}$, $t_{min}$, and $t_{max}$) values from the intrusion data measured while the PSS is in monitor mode.

A key pad may also be added to control face 26 (FIG. 2) to provide easier access to the system control and status parameters. Additionally, access to the hidden menu may be limited, for example, by requiring a user to type a password into the key pad.

Although several hidden menu items were described, many other possible menu items may be included. For instance, the PSS may include an external alarm output 250 (FIG. 5), and the user may be able to enable/disable or select parameters for such an external alarm output through an additional hidden menu item.

An external device may be hardwired to external alarm output 250 or to RS232 communication port 34 to immediately notify the external device when an alarm has been detected. Alternatively, the external alarm output may be a radio frequency (RF) transmitter for sending signals to an external RF receiver (e.g., pager or a cellular phone) for immediate alarm notification. As another alternative, the external alarm output or the RS232 port may be connected to another security device, for instance, a video camera with or without audio, such that upon detection of an alarm, the PSS enables the other security device.

In addition to alarm LED 22 (FIG. 5) and buzzer 23, the PSS may include additional alarms such as a strobe light or a local horn capable of generating a 107 db sound.

Because of the dual redundancy of the air pressure sensors and trigger circuits, CPU 39 may compare the outputs from trigger circuits 216*a* and 216*b* to determine whether both sensors and both trigger circuits are operating correctly. If one trigger circuit or sensor is determined to have failed, the CPU may write the event to the event log.

The circuits described above are only one embodiment. For example, the digital signal processing circuits within CPU 39 may be replaced by fast fourier transform circuits.

The security system described above may be used to detect pressure changes in media other than air, for example, water, provided that the air pressure sensors are replaced with appropriate media pressure sensors.

What is claimed is:

1. A security system comprising:

a pressure sensing circuit for generating an electrical signal in response to changes in pressure; and a signal processing circuit, connected to receive the electrical signal, for determining whether the electrical signal represents an intrusion pattern, wherein the electrical signal comprises an analog signal, wherein the signal processing circuit samples the analog signal and determines whether the samples represent the intrusion pattern.

2. The security system of claim 1, further comprising:

a notification circuit, connected to the signal processing circuit, for providing an external alarm notification when the signal processing circuit determines that the electrical signal represents the intrusion pattern.

3. The security system of claim 1, further comprising:

an event logging circuit, connected to the signal processing circuit, for writing event data to an event log in a memory connected to the signal processing circuit.

4. The security system of claim 3, wherein the event logging circuit writes event data to the event log when the signal processing circuit determines that the electrical signal represents the intrusion pattern.

5. The security system of claim 1, wherein the signal processing circuitry includes:

a digital signal processing circuit.

6. The security system of claim 1, wherein the signal processing circuit includes:

condition detection circuitry for determining whether the electrical signal meets at least one predetermined condition which represents the intrusion pattern.

7. The security system of claim 6, wherein the predetermined condition requires that a maximum intrusion peak amplitude of the electrical signal occur within a pulse width time period in which the electrical signal exceeds a pressure threshold value.

8. The security system of claim 6, wherein the predetermined condition requires that a pulse width time period, in which the electrical signal exceeds a pressure threshold value, be within a preset time range.

9. The security system of claim 6, wherein the predetermined condition requires that a difference between a maximum intrusion peak amplitude and a minimum intrusion peak amplitude be greater than an intrusion pressure threshold.

10. The security system of claim 6, wherein the predetermined condition requires that a difference between a maximum recovery peak amplitude and a minimum intrusion peak amplitude be greater than a recovery threshold.

11. The security system of claim 6, wherein the predetermined condition requires that a pulse width time period, in which the electrical signal exceeds a pressure threshold value, be greater than a preset time threshold.

12. The security system of claim 6, wherein the predetermined condition requires that an increase in the electrical signal be greater than a predetermined rate.

13. The security system of claim 1, wherein the pressure sensing circuit includes:

a temperature compensation circuit, connected to receive the electrical signal, for compensating for changes in the response of the pressure sensing circuit due to temperature.

14. The security system of claim 1, wherein the pressure sensing circuit includes:

a frequency compensation circuit, connected to receive the electrical signal, for conditioning the frequency response of the electrical signal.

15. The security system of claim 14, wherein the frequency compensation circuit conditions the electrical signal to provide a flat frequency response.

16. The security system of claim 1, wherein the pressure sensing circuit includes:

an amplifier for amplifying the electrical signal; and an adjustable gain calibration circuit for setting the gain of the amplifier in accordance with a calibration value.

17. The security system of claim 16, wherein the calibration value is selected by a user and down-loaded to the adjustable gain calibration circuit by the signal processing circuit.

18. The security system of claim 1, wherein the pressure sensing circuit includes:

an adjustable μbar range select circuit, connected to receive the electrical signal, for amplifying the electrical signal in accordance with a pressure threshold value.

19. The security system of claim 18, wherein the pressure threshold value is selected by a user and down-loaded to the adjustable μbar range select circuit.

20. The security system of claim 1, wherein the signal processing circuit further determines whether the electrical signal represents another intrusion pattern.

21. The security system of claim 1, wherein the signal processing circuit determines whether the electrical signal represents the intrusion pattern by comparing the electrical signal to a set of predetermined thresholds.

22. The security system of claim 21, wherein the set of predetermined thresholds are specific to an enclosed area within which the security system is to be used.

23. The security system of claim 22, wherein the enclosed area is an aircraft.

24. The security system of claim 21, wherein the set of predetermined thresholds are established by a user prior to arming the system.

25. The security system of claim 24, wherein the set of thresholds are in accordance with a user selected aircraft type.

26. The security system of claim 24, wherein the set of thresholds includes a pressure threshold $P_{TH}$, a minimum pulse width threshold $t_{min}$, and a evaluation period $t_{max}$.

27. The security system of claim 1, further comprising:

a display device, and a entry/exit button, connected to the signal processing circuit, for displaying, on the display device, available preset system thresholds.

28. The security system of claim 27, further comprising:

a select button, connected to the signal processing circuit, for selecting particular preset available thresholds.

29. The security system of claim 28, wherein the entry/exit button further causes display of a menu for modification of system thresholds and wherein the select button selects modified system thresholds.

30. The security system of claim 29, wherein the menu includes an event menu for displaying, erasing, or dumping an event log.

31. The security system of claim 29, wherein the menu includes a monitor menu item for detecting intrusions into an enclosed area and for measuring intrusion data associated with the intrusions, wherein the signal processing circuit determines the set of system thresholds from the measured intrusion data.

32. The security system of claim 1, wherein the security system is portable.

33. The security system of claim 1, wherein the pressure sensing circuit comprises an air pressure sensing circuit.

34. A security system comprising:

a pressure sensing circuit for generating an electrical signal in response to changes in pressure; and a signal processing circuit, connected to receive the electrical signal, for determining whether the electrical signal represents an intrusion pattern, further comprising:

a trigger circuit, connected to receive the electrical signal, for determining whether the electrical signal represents a possible intrusion and for waking up the signal processing circuit, when the electrical signal represents a possible intrusion, to initiate the signal processing circuit's determination as to whether the electrical signal represents the intrusion pattern.

35. The security system of claim 34, wherein the trigger circuit determines whether a peak of the electrical signal has an amplitude that exceeds an amplitude threshold.

36. The security system of claim 35, wherein the amplitude threshold is a floating amplitude threshold that compensates for ambient noise.

37. The security system of claim 35, wherein the trigger circuit determines whether a peak of the electrical signal has a pulse width that exceeds a pulse width threshold.

38. The security system of claim 34, wherein the pressure sensing circuit includes:

an amplifier for amplifying the electrical signal; and an adjustable gain calibration circuit for setting the gain of the amplifier in accordance with a calibration value.

39. The security system of claim 38, wherein the calibration value is down-loaded to the adjustable gain calibration circuit by the signal processing circuit.

40. The security system of claim 34, wherein the pressure sensing circuit includes:

an adjustable μbar range select circuit, connected to receive the electrical signal, for amplifying the electrical signal in accordance with a pressure threshold value.

41. The security system of claim 40, wherein the pressure threshold value is selected by a user and down-loaded to the adjustable μbar range select circuit.

42. A method of detecting intrusions comprising:

sensing changes in pressure;

generating an electrical signal in response to the sensed changes in pressure; and determining whether the electrical signal represents an intrusion pattern, wherein the electrical signal comprises an analog signal, wherein said determining includes sampling the analog signal by a signal processing circuit that determines whether the samples represent the intrusion pattern.

43. A method of determining security system thresholds, comprising:

providing a security system for detecting changes in air pressure to detect intrusions into enclosed areas, wherein the security system includes a monitor mode for measuring intrusion data in specific enclosed areas and for determining security system thresholds in accordance with the measured intrusion data.

44. The method of claim 43, further comprising:

placing the security system in a specific enclosed area; and selecting the monitor mode of the security system.

45. The method of claim 44, further comprising:

intruding into the specific enclosed area;

detecting the intrusion; and measuring intrusion data associated with the intrusion.

46. The method of claim 45, further comprising:

determining the security system thresholds from the measured intrusion data.

* * * * *